US005730539A

United States Patent [19]

Chabria

[11] Patent Number: 5,730,539

[45] Date of Patent: Mar. 24, 1998

[54] COMBINATION WRITING IMPLEMENT AND FLASHLIGHT

[75] Inventor: Paul R. Chabria, Wayne, Ill.

[73] Assignee: Press-A-Lite Corporation, West Chicago, Ill.

[21] Appl. No.: 583,472

[22] Filed: Jan. 5, 1996

[51] Int. Cl.[6] ..... B43K 29/00; B43K 29/10

[52] U.S. Cl. ..... 401/195; 362/118

[58] Field of Search ..... 401/195, 52, 104; 362/118, 205; 200/11 I, 11 E, 11 EA

[56] References Cited

U.S. PATENT DOCUMENTS

| | | | |
|---|---|---|---|
| 1,181,061 | 4/1916 | Bettencourt . | |
| 1,230,721 | 6/1917 | Kelly . | |
| 1,996,563 | 10/1935 | Billings . | |
| 2,261,320 | 1/1941 | Williams | 362/118 X |
| 2,368,839 | 5/1945 | Jansen . | |
| 2,407,106 | 3/1946 | Shelly . | |
| 2,979,602 | 4/1961 | Barnett . | |
| 3,004,140 | 4/1961 | Gomes . | |
| 3,045,111 | 7/1962 | Hoenig | 401/195 X |
| 3,259,701 | 7/1966 | Neff, Jr. | 200/11 EA X |
| 3,963,914 | 6/1976 | Breoning et al. | 401/195 X |
| 4,025,540 | 5/1977 | Key, Jr. et al. | 401/195 X |
| 4,168,521 | 9/1979 | Bajusz . | |
| 4,286,126 | 8/1981 | Berginski | 202/11 EA X |
| 4,348,715 | 9/1982 | Christensen et al. | 362/205 X |
| 4,538,036 | 8/1985 | Heinrich et al. | 200/11 EA X |
| 5,275,497 | 1/1994 | Shiau | 401/195 |
| 5,413,429 | 5/1995 | Shjiau | 401/195 |

FOREIGN PATENT DOCUMENTS

| | | | |
|---|---|---|---|
| 1511323 | 9/1966 | Germany | 362/118 |

*Primary Examiner*—D. Neal Muir

*Attorney, Agent, or Firm*—Lee, Mann, Smith, McWilliams, Sweeney & Ohlson

[57] ABSTRACT

A combination writing implement and flashlight including an electrically conductive generally tubular housing member having a chamber adapted to removably receive a battery. A rotatable electrical switch is attached to one end of the tubular member for providing selective electrical communication between the housing member and the battery disposed therein. A generally tubular sleeve formed from a light transmissive material is attached to the second end of the housing member. A writing device is located within the sleeve member and the writing tip of the writing device extends through the tip of the sleeve member. A retainer member located within the sleeve member secures the writing device to the sleeve member. An illuminating lamp is located within the housing and is engaged by the retainer member. The electrical switch is adapted to selectively open and close an electrical circuit between the battery and the lamp to selectively illuminate the lamp and thereby to transmit light through the retainer member and the sleeve member to the tip of the writing device and onto a writing surface.

14 Claims, 1 Drawing Sheet

COMBINATION WRITING IMPLEMENT AND FLASHLIGHT

BACKGROUND OF THE INVENTION

The present invention is directed to a combination writing implement and flashlight including a writing device and a lamp for illuminating a writing surface, and in particular to a combination writing implement and flashlight wherein the writing device, lamp and battery which energizes the lamp are each selectively removable and replaceable.

Various types of workers such as servicemen, inspectors and policemen are often required to write reports or take notes in the dark. This often requires the simultaneous manipulation of a writing implement, a writing surface such as a clipboard, and a flashlight. Trying to coordinate these three objects while writing is difficult at best. The present invention provides a combination writing implement and flashlight wherein the flashlight illuminates the writing surface on which the writing implement is used.

SUMMARY OF THE INVENTION

The present invention is a combination writing implement and flashlight comprising an electrically conductive generally tubular housing member having a chamber adapted to removably receive one or more batteries, each battery having a first terminal and second terminal. The tubular housing member has a first end and a second end with the first end having an opening such that the battery is selectively removable and replaceable in the chamber of the tubular housing member through the opening in the first end thereof. An electrical switch is attached to the second end of the housing member which provides selective electrical communication between the housing member and the battery. A generally tubular sleeve member having a first end and a second end and a chamber formed therein is removably attached to the housing member. The first end of the sleeve member includes a tip and a bore extending through the tip to the chamber of the sleeve member. The second end of the sleeve member includes an opening in communication with the chamber of the sleeve member. A writing device such as a pen or pencil is located within the chamber of the sleeve member and extends through the bore and the tip of the sleeve member. The writing device includes a first end which projects outwardly from the sleeve member and which includes a writing point for engagement with a writing surface. The writing device is selectively removable from the sleeve member through the opening in the second end of the sleeve member. A retainer member is removably located within the chamber of the sleeve member at the second end of the sleeve member. The retainer member has a first end and a second end. The first end is adapted to receive and retain the second end of the writing device. An illuminating lamp having a bulb is located in engagement with the second end of the retainer member. The illuminating lamp includes a first terminal adapted for electrical engagement with the battery and a second terminal adapted for electrical engagement with the housing member. The electrical switch is adapted to selectively close an electrical circuit between the battery and the lamp to thereby illuminate the lamp. The sleeve member and the retainer member are formed from light transmissive material such that light from the illuminated lamp is transferred to the tip of the sleeve member and is projected therefrom to the writing surface adjacent the writing point of the writing device.

DETAILED DESCRIPTION OF THE PREFERRED EMBODIMENT

Figure 1:
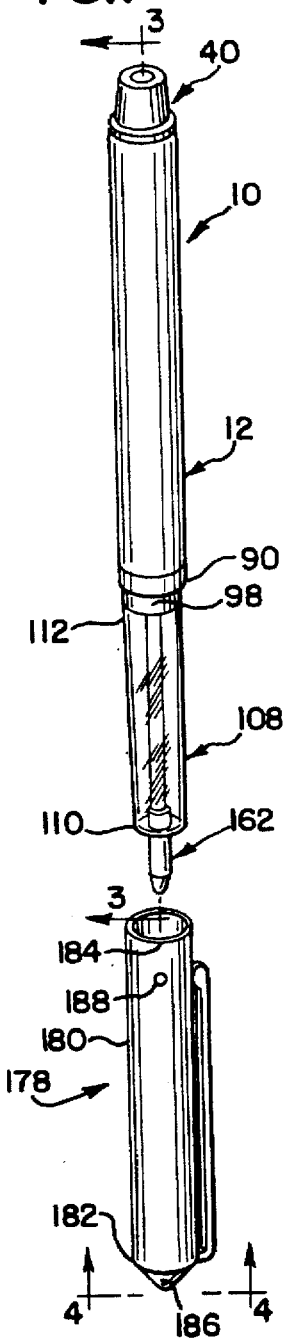
FIG. 1 is a perspective view of the combination writing implement and flashlight of the present invention.
Figure 2:
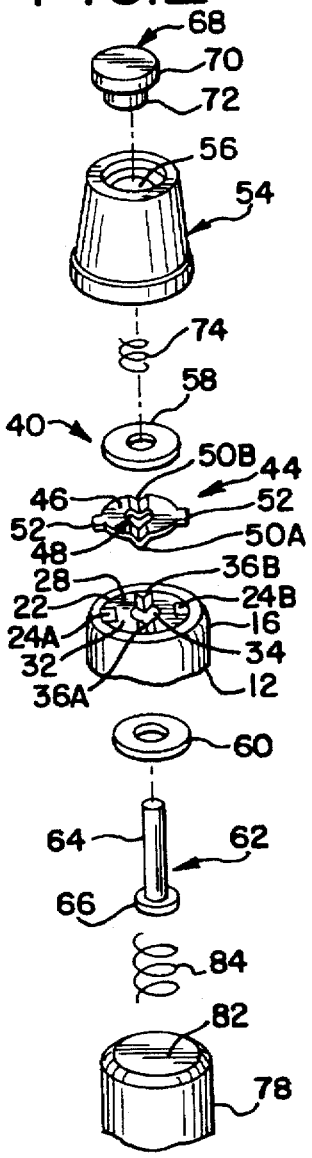
FIG. 2 is an exploded view of the electrical switch of the combination writing implement and flashlight.

One embodiment of the combination writing implement and flashlight 10 of the present invention is shown in FIGS. 1–4. The combination writing implement and flashlight 10 includes an elongate generally tubular housing member 12. The housing member 12 includes a first end 14, a second end 16, and a generally cylindrical side wall 18 forming a hollow chamber 20 therein. The first end 14 of the housing member 12 includes internal threads in the side wall 18 and an opening in communication with the chamber 20. The second end 16 of the housing member 12 includes a generally circular flange 22 which extends inwardly from the side wall 18 as best shown in FIG. 2. Diametrically opposed tabs 24A–B extend inwardly from the flange 22. The housing member 12, including the side wall 18, flange 22 and tabs 24A–B, are all formed from an electrically conductive material such as stainless steel or other such materials.

An electrical insulating member 28 having a generally cylindrical side wall 30 and a generally circular end wall 32 is located within the chamber 20 of the housing member 12 at the second end 16 in abutting relationship with the tabs 24A–B. The end wall 32 includes two diametrically opposing notches adapted to receive the tabs 24A–B in the exterior surface of the end wall 32. The end wall 32 also includes a centrally located circular aperture 34 and two diametrically opposing generally U-shaped or V-shaped grooves 36A and 36B in the exterior surface of the end wall 32 which extend radially outwardly from the aperture 34. The grooves 36A and B are located at approximately a 90° angle from the tabs 24A–B.

A rotatable electrical switch 40 is attached to the second end 16 of the housing member 12. The electrical switch 40 is selectively rotatable about an axis 42 which extends through the chamber 20 of the housing member 12. The electrical switch 40 includes a rotor 44, as best shown in FIG. 2, which includes a disc portion 46 having a centrally located generally circular aperture 48 and diametrically opposed generally U-shaped or V-shaped projections 50A–B which extend transversely from the disc portion 46 towards the insulating member 28. The projections 50A–B are elongate and extend radially from the aperture 48. The disc portion 46 also includes a pair of diametrically opposed ears 52 which project outwardly from the disc portion 46. The projections 50A–B are in sliding rotatable engagement with the insulating member 28 and tabs 24A–B of the housing member 12. The projections 50A–B space the disc portion 46 and ears 52 of the rotor 44 apart from the housing member 12. The rotor 44 is sized such that the diameter of the disc portion 46, with the exception of the ears 52, is smaller than the diameter of the interior rim of the flange 22 of the housing member 12.

The ears 52 of the rotor 44 are attached to an actuator member 54 formed from an electrical insulating material such as plastic. The rotor 44 and the actuator member 54 are conjointly selectively rotatable about the axis 42. The actuator member 54 includes a longitudinally extending bore 56 extending therethrough. A first generally circular washer 58 having a central aperture is located within the actuator member 54 and is located coaxially with the rotor 44 and insulating member 28. A second generally circular washer 60 having a centrally located aperture is located within the chamber 20 adjacent to the insulating member 28 and is coaxially aligned with the insulating member 28, rotor 44 and washer 58. A pin 62 includes an elongate generally cylindrical shaft 64 and a head 66. The shaft 64 of the pin 62 extends through the washer 60, aperture 34 of the insulating member 28, aperture 48 of the rotor 44, and washer 58. The shaft 64 of the pin 62 is connected to a fastener 68 located within the bore 56 of the actuator member 54. The fastener 68 includes a head 70 and a short cylindrical shaft 72 having a centrally located bore. The shaft 64 of the pin 62 extends into the bore of the fastener 68. The pin 62 and the fastener 68 rotatably retain the actuator member 54 and rotor 44 to the second end 16 of the housing member 12.

A resilient spring 74 extends around the shaft 64 of the pin 62 and extends between the end of the shaft 72 of the fastener 68 and the washer 58. The spring 74 resiliently biases the rotor 44 into engagement with the insulating member 28 or the tabs 24A–B of the housing member 12, depending upon the rotational orientation of the rotor 44. The spring 74 also resiliently biases the head 66 of the pin 62 and the washer 60 into engagement with the insulating member 28. The actuator member 54 and the rotor 44 are relatively rotatable with respect to the pin 62 and fastener 68. The pin 62, fastener 68, spring 74, washer 58 and rotor 44 are in electrical engagement with one another.

The rotor 44 is selectively rotatable, by manual rotation of the actuator member 54, between a first position wherein the projections 50A–B of the rotor 44 are positioned on and in electrical engagement with the tabs 24A–B of the housing member 12 to close an electrical circuit, and a second position as shown in FIG. 2 wherein the projections 50A–B are located within the grooves 36A–B of the insulating member 28 such that the rotor 44 is electrically insulated from the housing member 12 to open the electrical circuit. A 90° or quarter turn of the actuator member 54 is effective to move the rotor 44 between the first and second positions. The actuator member 54 and rotor 44 may be rotated in either a clockwise or counterclockwise direction with respect to the axis 42 as desired.

Figure 3:
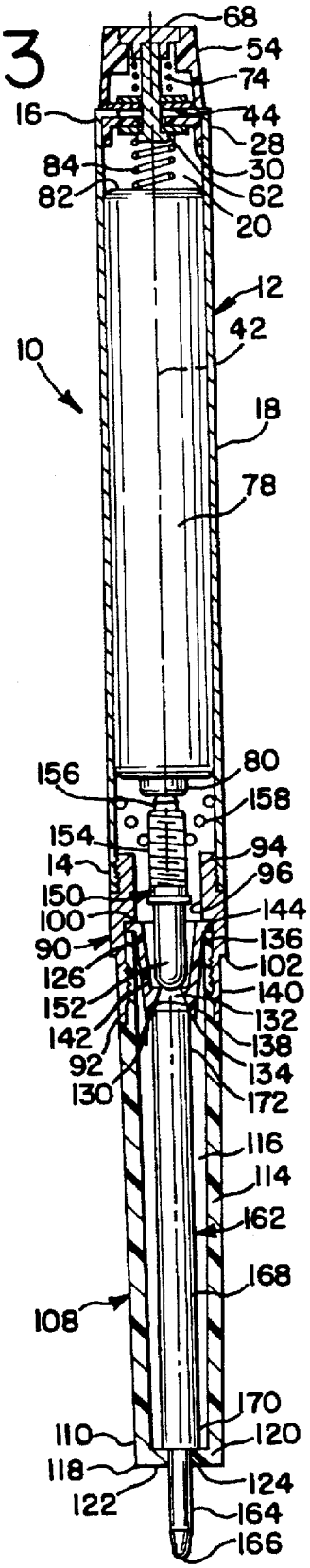
FIG. 3 is a cross-sectional view taken along lines 3—3 of FIG. 1.
Figure 4:
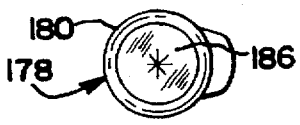
FIG. 4 is an end view of the cap of the combination writing implement and flashlight taken along lines 4—4 of FIG. 1.

A battery 78 having a first terminal 80 and a second terminal 82 is located within the chamber 20 of the housing member 12. The battery may be a AA, AAA, or AAAA battery, an N-cell battery, or other types of batteries as desired. Although only one battery is shown in FIG. 3, one or more batteries 78 may be located within the chamber 20 in an end to end relationship if desired. The first and second terminals 80 and 82 of the battery 78 are electrically insulated from direct contact with the side wall 18 of the housing member 12. A resilient electrically conductive spring 84 is located within the chamber 20 and extends between and engages the pin 62 and the second terminal 82 of the battery 78.

The combination writing implement and flashlight 10 also includes a collar 90 having a first end 92 and a second end 94. A bore 96 extends centrally through the collar 90 between the first end 92 and the second end 94. The second end 94 of the collar 90 is externally threaded such that the collar 90 is selectively threadably engaged with the first end 14 of the housing member 12. The bore 96 of the collar 90 and the chamber 20 of the housing member 12 are coaxially aligned with one another. The collar 90 includes a reduced diameter portion 98 at the second end 94 which includes internal threads. The collar 90 also includes an internal annular lip 100, and an external annular lip 102. If desired, the collar 90 may be formed integrally with the housing member 12.

The combination writing implement and flashlight 10 also includes a generally tubular sleeve member 108 having a first end 110 and a second end 112. The sleeve member 108 includes a generally tubular side wall 114 which extends between the first end 110 and second end 112 which forms a chamber 116 therein. The side wall 114 is generally cylindrical and tapers slightly inwardly from said second end 112 to said first end 110. The sleeve member 108 includes a tip 118 at the first end 110. The tip 118 includes an end wall 120 having a concave exterior surface 122. The end wall 120 includes a bore 124 extending therethrough to the chamber 116. The second end 112 of the sleeve member 108 includes a circular rim 126 which forms an opening to the chamber 116. The second end 112 of the sleeve member 108 is externally threaded such that the sleeve member 108 is selectively threadably engaged to the first end 92 of the collar 90 and is selectively removable from the collar 90. The sleeve member 108 is formed from a light transmissive material such as clear or transparent plastic.

A retainer member 130 is located within the chamber 116 at the second end 112 of the sleeve member 108. The retainer member 130 includes a bore 132 extending between a first end 134 and a second end 136 of the retainer member 130. The bore 132 includes a generally conical wall portion 138 at the first end 134 which converges inwardly and a generally conical wall portion 140 at the second end 136 which converges inwardly. An annular wall 142, which is generally perpendicular to the axis 42, extends between the conical wall portion 138 and the conical wall portion 140. The second end 136 of the retainer member 130 includes an outwardly extending circular flange 144. The flange 144 is adapted to be located between the rim 126 of the sleeve member 108 and the internal annular lip 100 of the collar 90. When the sleeve member 108 is removed from the collar 90 and housing member 12, the retainer member 130 may be removed from the sleeve member 108 and the collar 90. The retainer member 130 is formed from a light transmissive material such as clear or transparent plastic.

An illuminating lamp 150 is located within the chamber 20 of the housing member 12, the bore 96 of the collar 90, and the chamber 116 of the sleeve member 108. The lamp 150 includes a bulb 152, a first terminal 154 and a second terminal 156. The bulb 152 extends within the portion of the bore 132 of the retainer member 130 formed by the conical wall portion 140 and the tip of the bulb 152 engages the annular wall 142 of the retainer member 130. The second terminal 156 of the lamp 150 electrically engages the first terminal 80 of the battery 78. An electrical conductor member 158, such as a generally conical shaped spring, electrically engages the first terminal 154 of the bulb 152 and the sidewall 18 of the housing member 12. The spring 84 resiliently biases the battery 78 into engagement with the second terminal 156 of the lamp 150 and the tip of the bulb 152 into engagement with the annular wall 142 of the retainer member 130.

The combination writing implement and flashlight 10 also includes a writing device 162. The writing device 162 includes a writing tip 164 having a writing point 166 and a cylindrical tube 168 having a first end 170 and a second end 172. The writing tip 164 extends concentrically within the first end 170 of the tube 168 with the writing point 166 projecting outwardly from the tube 168. The writing device 162 is generally concentrically located within the sleeve member 108 such that the first end 170 of the tube 168 abuts the end wall 120. The writing tip 164 extends through the bore 124 such that the writing point 166 is located externally to the sleeve member 108. The second end 172 of the tube 168 is located within the bore 132 of the retainer member 130 with the second end 172 engaging the conical wall portion 138 of the retainer member 130. The writing device 162 is preferably a pen cartridge and the tube 168 typically contains ink which is dispensed through the writing point 166 onto a writing surface. The writing device 162 may alternatively be a marker, a mechanical pencil or the like.

The combination writing implement and flashlight 10 also includes a cap 178. The cap 178 includes a cylindrical and tubular side wall 180 having a first end 182 and a second end 184. The first end 182 of the side wall 180 is closed by an end wall 186 which is preferably formed from a light transmissive material. The second end 184 of the tubular side wall 180 forms an opening. The side wall 180 also includes an aperture 188. The cap 178 may be placed over the sleeve member 108 to substantially enclose the sleeve member 108 and writing device 162 therein. When the cap 178 is placed over the sleeve member 108 and writing device 162, the second end 184 of the cap 178 engages the reduced diameter portion 98 of the collar 90 with a friction fit such that the cap 178 is removably attached to the collar 90. When the cap 178 is placed over the sleeve member 108, such as when the combination writing implement and flashlight 10 is not intended for use, if the lamp 150 is inadvertently left in an illuminated condition, light from the lamp 150 will be visible through the end wall 186 and also through the aperture 188 in the cap 178 thereby providing an indication to the user to deactivate the lamp 150. When the cap 178 is removed from the collar 90, the actuator member 54 may be inserted into the opening at the second end 184 of the cap 178. The second end 184 of the cap 178 engages the actuator member 54 with a friction fit such that the cap 178 is removably retained by the actuator member 54. Rotation of the cap 178 with respect to the housing member 12 causes conjoint rotation of the actuator member 54.

In operation, the cap 178 is removed from the collar 90 and is attached to the actuator member 54. The actuator member 54 is then rotated to selectively activate or deactivate the lamp 150. When the lamp 150 is activated and the bulb 152 is illuminated, light from the bulb 152 is transmitted through the retainer member 130, and through the chamber 116 and side wall 114 of the sleeve member 108, to the end wall 120 of the sleeve member 108. The light from the bulb 152 is transmitted from the sleeve member 108 through the surface 122 of the end wall 120 to the writing surface. The curvature of the surface 122 focuses the light on an area around the writing point 166 of the writing device 162 to illuminate the portion of the writing surface in contact with the writing point 166. The lamp 150 is de-energized by rotating the actuator member 54, and thereby the rotor 44, approximately 90° in either direction about the axis 42. The cap 178 may then be placed over the sleeve member 108.

When the writing device 162 requires replacement, the sleeve member 108 may be removed from the collar 90. The retainer member 130 and the writing device 162 may then be removed from the sleeve member 108 through the opening at the second end 112 of the sleeve member 108. A new writing device 162 may then be inserted into the retainer member 130 and replaced into the sleeve member 108, whereupon the sleeve member 108 is reattached to the collar 90.

The lamp 150 and/or battery 78 may be removed and replaced by disengaging the housing member 12 from the collar 90. The lamp 150 may then be removed from the housing member 12 and replaced, and the battery 78 may also be removed and replaced.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A combination writing implement and flashlight comprising:

an electrically conductive housing member including a chamber adapted to removably receive a battery having a first terminal and a second terminal, said housing member having a first end and a second end, said first end having an opening such that the battery is removable and replaceable in said chamber through said opening in said first end;

an electrical switch attached to said second end of said housing member, said electrical switch providing selective electrical communication between said housing member and the battery;

a sleeve member having a first end and a second end and a chamber formed therein, said second end of said sleeve member being removably coupled to said housing member, said first end of said sleeve member including a tip and a bore extending through said tip;

a writing device located within said chamber of said sleeve member and extending through said bore in said tip of said sleeve member, said writing device including a first end and a second end, said first end of said writing device projecting outwardly from said tip of said sleeve member, said writing device being selectively removable from said sleeve member through said second end of said sleeve member when said sleeve member is removed from said housing member;

a retainer member removably located within said chamber of said sleeve member at said second end of said sleeve member, said retainer member having a first end, a second end and a bore extending through said retainer member from said first end to said second end, said second end of said writing device located within a conical seat in said bore of said retainer member at said first end of said retainer member; and an illuminating lamp having a first terminal in electrical engagement with the battery, a second terminal in electrical engagement with said housing member, and a bulb located at least partially within said bore of said retainer member at said second end of said retainer member;

whereby said electrical switch is adapted to selectively close an electrical circuit between the battery and said lamp to thereby illuminate said lamp and project light from said tip of said sleeve member.

2. The combination writing implement and flashlight of claim 1 wherein said retainer member includes a first generally conical side wall portion at said first end of said retainer member and a second generally conical side wall portion at said second end of said retainer member, said first conical side wall portion adapted to receive said second end of said writing device.

3. The combination writing implement and flashlight of claim 3 wherein said retainer member includes a generally annular wall extending between said first and second conical side wall portions.

4. The combination writing implement and flashlight of claim 1 including a collar having a first end and a second end and a bore extending from said first end to said second end of said collar, said first end of said collar being removably attached to a said second end of said sleeve member and said second end of said collar being removably attached to said first end of said housing.

5. The combination writing implement and flashlight of claim 1 wherein said second end of said retainer member includes an outwardly extending flange, said flange adapted to be located between said housing member and said sleeve member to hold said retainer member in place.

6. The combination writing implement and flashlight of claim 1 including an electrical conductor member electrically engaging said second terminal of said lamp and said housing member.

7. The combination writing implement and flashlight of claim 6 wherein said electrical conductor member comprises a spring.

8. The combination writing implement and flashlight of claim 1 wherein said sleeve member is formed from a light transmissive material.

9. The combination writing implement and flashlight of claim 1 wherein said retaining member is formed from a light transmissive material.

10. The combination writing implement and flashlight of claim 1 including a cap adapted to be removably placed over said sleeve member.

11. The combination writing implement and flashlight of claim 10 wherein said cap includes a side wall and an aperture in said side wall, said aperture providing visual indication of whether said lamp is illuminated when said cap is placed over said sleeve member.

12. The combination writing implement and flashlight of claim 11 wherein said cap includes an end wall formed from a light transmissive material such that said end wall provides visual indication of whether said lamp is illuminated when said cap is placed over said sleeve member.

13. The combination writing implement and flashlight of claim 1 wherein said second end of said housing member includes an inwardly projecting tab and said electrical switch includes a selectively rotatable rotor, said rotor being rotatable between a first position wherein said rotor is in electrical engagement with said tab of said housing member thereby completing an electrical circuit to illuminate said lamp, and a second position wherein said rotor is out of electrical engagement with said tab.

14. The combination writing implement and flashlight of claim 13 wherein said rotor comprises a disc portion and a projection extending outwardly from said disc portion, said projection selectively engaging said tab when said rotor is located in said first position.

* * * * *